United States Patent [19]

Gosslar et al.

[11] Patent Number: 4,851,735

[45] Date of Patent: Jul. 25, 1989

[54] SINGLE-ENDED HIGH-PRESSURE DISCHARGE LAMP WITH COIL AND MANDREL ELECTRODE

[75] Inventors: Achim Gosslar; Jürgen Heider, both of Munich, Fed. Rep. of Germany

[73] Assignee: Patent-Treuhand Gesellschaft fur elektrische Gluhlampen m.b.H, Munich, Fed. Rep. of Germany

[21] Appl. No.: 120,945

[22] Filed: Nov. 16, 1987

[30] Foreign Application Priority Data

Dec. 1, 1986 [DE] Fed. Rep. of Germany ..... 3641045

[51] Int. Cl.[4] ..... H01J 17/04; H01J 61/073

[52] U.S. Cl. ..... 313/631; 313/621; 313/633

[58] Field of Search ..... 313/631, 633, 620, 621, 313/344, 352, 574, 575, 549, 558

[56] References Cited

U.S. PATENT DOCUMENTS

| | | | |
|---|---|---|---|
| 2,116,720 | 5/1938 | Wiegand | 313/620 X |
| 2,363,531 | 11/1944 | Johnson | 313/575 X |
| 2,682,007 | 6/1984 | Hilder et al. | 313/352 |
| 2,687,489 | 8/1954 | Anderson, Jr. et al. | 313/344 |
| 3,067,357 | 12/1962 | Fridrich | 313/633 |
| 3,349,276 | 10/1967 | Jacobs et al. | 313/344 X |
| 3,882,345 | 5/1975 | Kazek et al. | 313/639 |
| 4,208,609 | 6/1980 | Berlec | 313/315 |
| 4,340,836 | 7/1982 | Bergman et al. | 313/631 |
| 4,415,829 | 11/1983 | Rothwell, Jr. et al. | 313/621 |
| 4,633,136 | 12/1986 | Fromm et al. | 313/623 |
| 4,636,687 | 1/1987 | Keeffe et al. | 313/620 |
| 4,717,852 | 1/1988 | Dobrusskin et al. | 313/634 X |

FOREIGN PATENT DOCUMENTS

| | | | |
|---|---|---|---|
| 242736 | 2/1987 | German Democratic Rep. | |
| 30058 | 2/1983 | Japan | 313/631 |
| 220544 | 11/1985 | Japan | 313/574 |
| 2072412 | 9/1981 | United Kingdom | |
| 2126415 | 3/1984 | United Kingdom | |

OTHER PUBLICATIONS

Kaufman; FES Lighting Handbook; 12/86, 4th Edition, p. 8–5.

"Electrode Development for Small Halogen Metal Vapor Lamps", published in Technisch—Wissenschaftliche Abhandlugen der OSRAM—Gesellschaft (Technological and Scientific Discussions of the OSRAM Company) vol. 12, p. 65 et seq. Published by Springer, Berlin 1986.

*Primary Examiner*—Donald J. Yusko
*Assistant Examiner*—Michael Horabik
*Attorney, Agent, or Firm*—Frishauf, Holtz, Goodman & Woodward

[57] ABSTRACT

To improve the heat distribution of single-ended metal-halide high-pressure discharge lamps, and particularly lamps in which the fill is apt to attack a helically wound electrode (4) facing a similar electrode (5) within a discharge vessel (2), the end portions of the electrodes have a mandrel or pin element (17) located within a plurality of coiled windings (16), such that the coiled windings of the electrodes surround the mandrel or pin elements (17). Preferably, the mandrel is made of thorium dioxide-doped tungsten, and the electrodes includes an electrode shaft portion (15) pinch-sealed through the quartz-glass vessel. The shaft portions are unitary with the coiled windings (16) and are made of undoped, essentially pure tungsten. The mandrel (17) may be retained within the coiled filament portion (16) by clamping or by being end-melted thereto, and preferably projects beyond the helical windings at the side remote from the discharge to improve the overall temperature distribution within the discharge vessel (2).

23 Claims, 3 Drawing Sheets

SINGLE-ENDED HIGH-PRESSURE DISCHARGE LAMP WITH COIL AND MANDREL ELECTRODE

Reference to related literature:

British Pat. No. 2,072,412, Rothwell et al;

British Patent No. 2,126,415, Dobrusskin et al, assigned to the assignee of the present application;

U.S. Pat. No. 4,633,136, Fromm et al, assigned to the assignee of the present application.

U.S. Pat. No. 4,717,852, Jan. 5, 1988, based on

U.S. Ser. No. 802,073, filed Nov. 26, 1985 (Continuation of Ser. No. 515,387, filed July 20, 1983) Dobrusskin, Heider and Gosslar, assigned to the assignee of this application (to which German OS No. 32 32 207 corresponds), the disclosure of which is hereby incorporated by reference.

Article by D.C. Fromm, of the staff of a related company of the assignee of the present application, entitled, in translation, "Electrode Development for Small Halogen Metal Vapor Lamps", published in Technisch-wissenschaftliche Abhandlungen der OSRAM-Gesellschaft (Technological and Scientific Discussions of the OSRAM company), vol. 12, page 65 et seq., published by Springer, Berlin, 1986.

U.S. Pat. No. 4,208,609, Berlec.

The present invention relates to a high-pressure discharge lamp, and more particularly to a low-power single-ended highpressure discharge lamp, that is, a discharge lamp having a rated power of between about 35 to 150 W, in which a fill of mercury, a noble gas, and metal halides, is retained within a quartz-glass discharge vessel.

BACKGROUND

High-pressure discharge lamps of the type to which the present invention relates are described, for example, in British Pat. No. 2,126,415, and German Patent Disclosure Document No. 32 42 840. Such lamps are suitable for use at low power levels, that is, in the order of between 35 W to 150 W rated power, so that they are also suitable for interior room illumination.

The lifetime of such lamps is limited by the aggressive fill used within the lamp vessel, which results in corrosion of the electrods. This problem is particularly acute if the fill includes a substantial component of tin halides. Due to the high loading, the coiled portion of the electrodes tends to deform, thus changing the spacing of the electrode tips, which results in changes of light outout and lamp power.

THE INVENTION

It is an object to improve high-pressure discharge lamps, and more particularly low power high-pressure discharge lamps, to increase the lifetime thereof and decrease changes in operating characteristics.

Briefly, the lamp is made with a pair of electrodes having essentially parallel shaft portions which terminate in facing coiled ends. In accordance with the present invention, the coiled ends surround a mandrel or core pin with a mandrel factor which is at least 100%, and preferably higher. The electrode, including the coiled portion, may be made of undoped tungsten; the mandrel or core pin, however, may be doped with substances which have a low electron emission work function.

"Mandrel factor" or percent mandrel is defined by the diameter D of the mandrel divided by the diameter d of the filament wire, times 100 (see, for example, U.S. Pat. No. 4,208,609, Berlec, assigned General Electric Co.).

The arrangement in accordance with the present invention has the advantage that corrosion of the electrodes is substantially reduced by the association of the mandrel therewith. The cause for this reduction is not entirely understood. It is believed, however, that the temperature profile along the electrodes is changed by the presence of the mandrel to improve and positively change the halogen cycle, so that the tungsten degradation no longer primarily takes place at the relatively cold regions of the electrode shaft in the vicinity of the pinch or press seal to the glass bulb.

The presence of the mandrel or core pin increases the heat capacity of the electrodes, particularly within the region of the coiled portion thereof. At the same time, the heat conduction along the electrode shaft is low, since the diameter of the electrode wire can be kept to a small dimension. Thus, the temperature distribution within the discharge vessel is rendered more uniform, so that the dependence of color temperature on operating position is reduced. The time from electrical arc-over to acceptance of the arc by the electrodes is reduced, so that the ignition characteristics of the lamp are improved. The enhanced heat capacity also decreases the amplitude of the periodic temperature variations, that is, temperature variations which change with the frequency of the alternating current supply. The reduction in temperature variation at the electrodes thus decreases the re-ignition peaks.

The presence of the core pin or mandrel within a coiled electrode has the advantage that the electrode coil is mechanically stabilized and thus deformation thereof by bend-through or the like is prevented. Changes in light output, therefore, are essentially eliminated.

DRAWINGS

DETAILED DESCRIPTION

Figure 1:
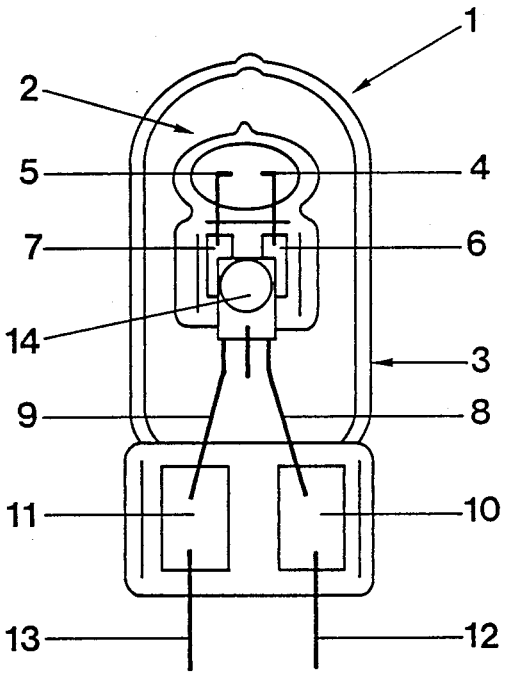
FIG. 1 is a schematic front view of a single-ended low-power high-pressure discharge lamp having an outer bulb surrounding the discharge vessel itself.

The general structure of the lamp is best seen in FIG. 1: Lamp 1, in the example selected, has a rating of 150 W. The lamp has a single-ended discharge vessel 2 of quartz glass, which is surrounded by a likewise single-ended outer bulb 3, also of quartz glass. Schematically shown electrodes 4, 5 are pinch-sealed by foil inserts 6, 7 through the discharge vessel 2; current supply leads 8, 9, extending to sealing foils 10, 11 and terminating in connection wires 12, 13, are retained within the outer bulb 3, likewise by a pinch seal. The connecting lines 12, 13 connect with a ceramic base—not shown, and of any suitable and standard construction. FIG. 1 further illustrates a getter 14, retained on a suitable wire which is also melted into the pinch seal of the discharge vessel 2, but free from connection with any voltage supply, so as to be free of potential.

The arc tube or vessel 2 contains a fill of mercury and a noble gas; the arc tube or discharge vessel 2 has a volume of about 0.65 $cm^3$, and retains mercury—about 15 mg—and a noble gas, as well as additives of metal iodides and bromides; suitable metals are sodium, tin, thallium, indium, and lithium. Overall, about 2.3 mg metal halides and additionally 0.2 mg tin are used. The operating pressure is about 35 bar. Lamp 1 has a nominal rated current of 1.8 A, and a light output of 83 lm/W.

Figure 2:
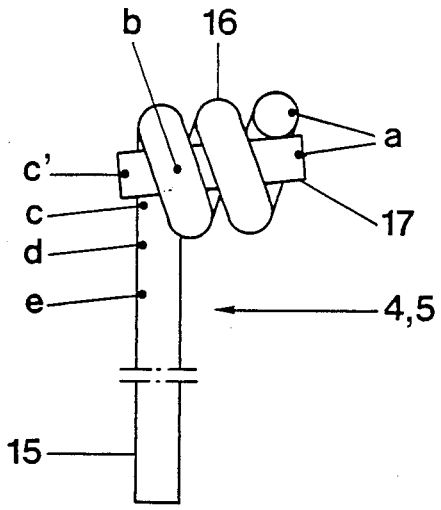
FIG. 2 is a pictorial view of the end portion of an electrode showing a preferred form.

In accordance with the present invention, the electrodes 4, 5 are constructed as shown in FIG. 2. A straight shaft or shank portion 15 of 8.7 mm length has a coiled end portion 16 integrally formed thereon. The coiled end portion 16 has $2\frac{1}{4}$ windings with an outer diameter of 1.5 mm. The shaft 15 and the coiled portion 16 are formed of a single unitary wire of 0.5 mm diameter. The coiled portion 16 is angled off with respect to the shaft 15 by 90°, so that the discharge will extend transversely to the shaft portions 15. Actually, the angled-off from a straight shank portion 16 is angled off by slightly less than 90° for manufacturing reasons, the precise value depends on the diameter of the electrode wire and the pitch of the helical portion 16.

The clearance between the winding loops of the helical portion 16 is 0.05 mm. The helical portion has an inner diameter of 0.45 mm. The material of the electrodes 4, 5, that is, of the shaft 15 and the helical wire 16, is undoped tungsten. No emitter or emitter paste is used.

Figure 3:
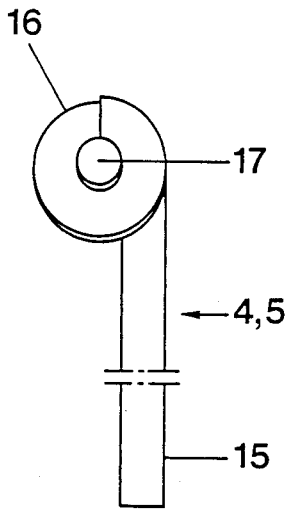
FIG. 3 is an end view of the electrode of FIG. 2, rotated 90° with respect to FIG. 2.

In accordance with a feature of the invention, a mandrel or core pin 17 of tungsten which is enriched with 0.7% (by weight) of thorium dioxide is fitted into the helical portion 16. The mandrel 17 thus is located also at approximately 90° with respect to the shaft 15 actually slightly more than 90°, as seen in FIG. 2. The mandrel 17 has a length of 1.9 mm, and a diameter of 0.5 mm, so that the mandrel factor is 100%. The mandrel 17 terminates at an end facing the opposite electrode flush with the tip of the helical portion 16. The spacing between electrodes, 4, 5, at their facing position, is 6.5 mm. At the end of the core or mandrel 17 remote from the discharge end, the mandrel 17 extends beyond the shaft 15 by about 0.2 mm. The mandrel is retained in position within the helical portion 16 simply by the clamping effect of the helical portion 16. FIG. 3 illustrates the electrode 4,5 rotated 90° with respect to FIG. 2. The central axis of the helical portion 16, including the core pin 17, is laterally offset with respect to the shaft 15. This is based on manufacturing considerations, in that the wound portion 16 and shaft 15 are made of one single wire element, in which the shaft 15 is tangentially carried away from the wound portion 16 during manufacture. Consequently, the electrodes 4, 5 are so placed in the lamp that the central axes of the two wound portions are aligned with respect to each other.

Figure 4:
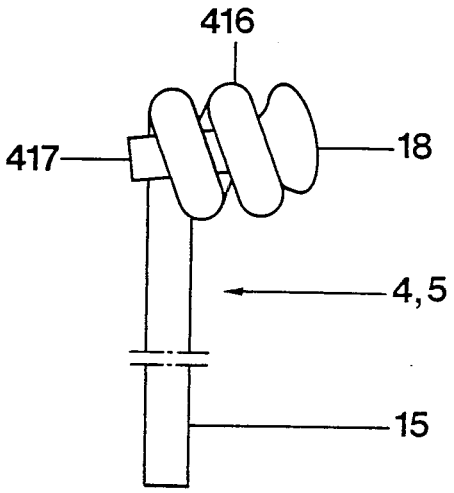
FIG. 4 is a view similar to FIG. 2 illustrating another embodiment which is preferred for some uses.

FIG. 4 illustrates another arrangement of attachment of the mandrel. The mandrel 417 is melted together with the helical portion 416. This arrangement has the advantage that the tolerances in making the mandrel 417 (diameter 0.5 mm) and the helical portion (inner diameter 0.55 mm) are less critical. Due to the melting-together, a melt cap 18 is formed, which insures stable arc initiation.

Figure 5:
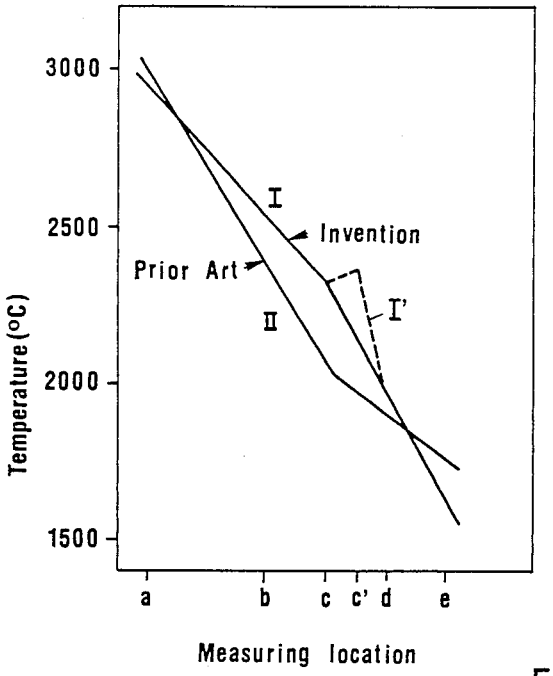
FIG. 5 is a comparison graph showing temperature along the electrodes with, or without a mandrel.
Figure 6:
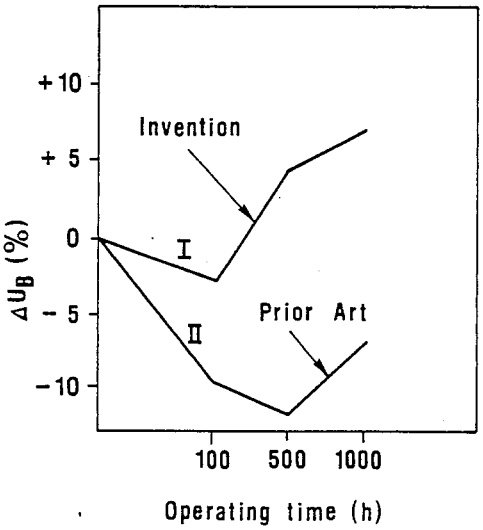
FIG. 6 shows comparison graphs of change from original arc voltage as a function of operating time for similar shapes of electrodes.

Comparison data with respect to prior art structures, with reference to FIGS. 5 and 6:

Comparison data will be given in which prior art electrodes identical to those shown in FIG. 2 without, however, the mandrel 17, and electrodes in accordance with the present invention, which include the mandrel 17, will be described. Graphs I illustrate the characteristics in accordance with the present invention, whereas graphs II are related to prior art structures. In all respects, the lamps were identical—except for the presence of the mandrel 17.

In addition to the graphs, it should be noted that the corrosion of the electrodes in the lamp of the present invention is substantially decreased with respect to that of prior art lamps, so that the average lifetime could be increased over prior art lamps which do not have the mandrel 17 by about 20%.

FIG. 5 illustrates the temperature relationship with respect to locations on the electrode, identified by measuring locations a to e.

As can be seen, by using an electrode with a mandrel, curve I, the temperature drop from the point of arc at measuring location a to the end of the helical portion, measuring locations b, c, is substantially less—due to the increased heat capacity—than in the prior art structure without the mandrel. The temperature drop in the region of the shaft, however, that is measuring locations d and e, is substantially higher, resulting in reduced heat conduction along the shaft 15 to the pinch seal. The measuring location e is located close to the inner wall of the pinch seal. The portion of the mandrel having measuring location c', and extending beyond the shaft portion—which, of course, does not have an equivalent in the prior art structure—shows an abnormal temperature behavior, since the temperature increases somewhat with respect to the measuring point c, see the broken line I'. The sharply reduced corrosion of the electrodes, which was observed, probably is due to this substantially changed temperature distribution.

Comparison of change of output power of the two types of lamps is shown in FIG. 6. The variation $\Delta U_B$ of the arc voltage $U_B$, in percent, is used as a meausre for change in power. The absolute value of the arc voltage is about 100 V. The substantial drop of arc voltage, maximum 12%, during the first thousand hours of operation of the prior art lamp is typical. This behavior appears to be due to the decrease of electrode spacing as a consequence of bending and deformation of the helical portion of the electrode wire. The improved stabilization of the electrodes with the mandrel, as seen in curve I, shows the substantially smaller drop of operating voltage, a maximum of 2.5%.

The ease of starting of firing can be judged by considering the relationship of the re-ignition voltage $U_W$ to the operating voltage $U_B$ of a lamp. This relationship $U_W/U_B$ should be small, and the smaller the value, the better the acceptance of the arc. Lamps which have a mandrel in the electrode have, as can be expected, a higher facility of ignition, $U_W/U_B=1.52$ than prior art lamps in which this ratio is 1.56.

Example of high-pressure discharge lamp of 35 W nominal power:

A discharge vessel 2 of generally ellipsoidal shape has an interior volume of 0.07 $cm^3$ has electrodes 4,5 (FIG. 7) located therein, made of undoped or non-doped tungsten wire, with a wire diameter of 0.25 mm. The straight shaft portion 15 has a length of 5.7 mm, and the helical winding 716, unitary with the shaft portion 15, has $1\frac{1}{4}$ windings with an outer diameter of 0.80 mm. The mandrel 717, including 0.7% (by weight) of $ThO_2$, the remainder tungsten, has a length of 1.22 mm, and a diameter of 0.3 mm, so that the mandrel factor is 120%. The end facing the opposite electrode, that is, the discharge end, projects by 0.3 mm beyond the end of the winding 716. Electrode spacing is 4 mm. The mandrel 717 extends by 0.2 mm beyond the shaft portion 15 at the side opposite the discharge. The fill in the discharge vessel has proportions similar to the first embodiment; bromine, however, is replaced by iodine, and an additional excess of tin is introduced.

This lamp, similar to the 150 W lamp described, has improved operating characteristics with respect to prior art lamps.

Fills of other metals and halides may be used in order to obtain different color temperatures and light colors; for example, a fill with iodides of sodium, thallium, and various rare earths, such as Dy, Ho, and Tm, provides for an increased color temperature.

The precise dimensions of the electrodes as well as of the mandrels used therewith depend on the geometry of the discharge vessel and the power rating of the lamp. A compromise must be made between reduction of electrode corrosion and good ignition characteristics. The composition of the lamp fill likewise influences the electrode dimensions.

The important parameters for lamp operation in single-ended metal halide discharge lamps can be readily influenced and optimized. A particularly desirable relationship between high heat capacity at the electrode tip, that is, in the region of the helical portion 16, and low heat conduction along the electrode shaft is obtained if the mandrel factor of the electrode is equal to or greater than 100%. Using materials for the mandrel which has a low electron emission work function, usually tungsten doped with $ThO_2$, permits a compromise between two, in prior art, contradictory requirements if the electrode itself is made of undoped tungsten wire. On the one hand, a thorium content as low as possible is desirable so that the color spectrum of the lamp is not adulterated; on the other hand, high doping of only the electrode tip, which is now feasible due to the mandrel, prevents malfunction upon ignition of the lamp, the malfunction having occurred in prior art due to the arc-over between the shafts of the electrodes made from doped tungsten wire, in the vicinity of the pinch or press seal, and retention of the arc in that region.

Figure 7:
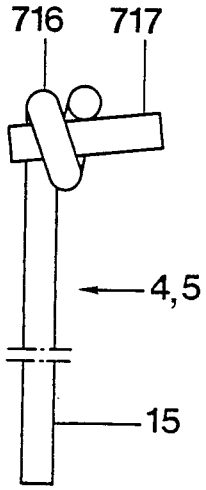
FIG. 7 is a view similar to FIG. 2 illustrating another and desirable embodiment of an electrode.

Placing the mandrel 17 such that is projects beyond the end of the electrode at the portion facing the discharge—see FIG. 7, for example—is of advantage particularly in extremely low power lamps, for example the 35 W lamp described. It should be noted that the drawings, and especially FIGS. 2, 3, 4 and 7, are not drawn to scale, and the projection of the mandrel as well as the windings of the helical portion are exaggerated for ease of understanding. Projecting the mandrel 17 beyond the helical portion 16—see FIG. 7—facilitates start of the arc discharge and stabilization of the resulting arc. A similar result can be obtained in double-ended lamps by fitting a helical portion on a straight shaft. In single-ended lamps, use of a core pin or mandrel, however, results in substantially easier manufacture, since attachment of the mandrel 17 to the helical winding 16 can be simply done by clamping.

Higher watt versions of lamps, for example 150 W, and having a relatively larger diameter of the mandrel, may desirably be made such that the mandrel 17 terminates flush with the helical winding 16—see FIG. 2. Attachment, again, can be simply by clamping of the mandrel within the winding 16, or, alternatively, by melting-together the mandrel 17 and the end portion of the helical winding 16 at the end facing the discharge. Such as a melt connection—see FIG. 4—results in the end cap or melt dot, which further facilitates stable initiation and burning of the arc.

Projecting the mandrel beyond the end of the helical portion remote from the arc—see region c′ of FIG. 2—permits control of the temperature of the volume of the discharge vessel in a simple manner by merely suitably selecting the extent of projection of the mandrel 17, 417 beyond the shaft portion 15 in the region of the windings 16, 416. This arrangement permits preventing the formation of undesired cold spots within the lamp.

The core pin or mandrel 17, 417 effectively decreases or inhibits corrosion in lamps which have fill components which are highly aggressive with respect to the internal components of the lamp. This is particularly important when tin halides are used in the lamp in order to obtain warm light color rendition.

Various changes and modifications may be made, and features described in connection with any one of the embodiments may be used with any of the others, within the scope of the inventive concept.

We claim:

1. Single-ended highpressure metal halide discharge lamp for low power rating, having a discharge vessel (2);

a pair of electrodes (4, 5) extending into said vessel and having generally parallel shaft portions (15) sealed into a pinch or press seal and leading into the interior of said vessel, and electrode end portions extending at an angle of about at least 90° with respect to said shaft portions and facing each other; and a fill of mercury, a noble gas and an additive of at least a metal halide in the discharge vessel so that, in operation of the lamp, a regenerative halogen cycle will result, comprising, in accordance with the invention, an arrangement for distributing the temperature gradients within the discharge vessel in the vicinity of the electrodes to thereby affect the regenerative halogen cycle during lamp operation for reducing degradation and distortion of the electrode shaft portion due to corrosion as a result of attack on the electrode shaft portions by the halides in the fill during occurrence of the halogen cycle, said arrangement comprising a mandrel element (17) located at the end portions of the electrodes (4, 5) and at least one coiled winding (16) extending from the shaft portion (15) of the electrodes surrounding said mandrel element (17), the shaft portion (15) and the coiled windings (16) comprising a single unitary wire element.

2. The lamp of claim 1, wherein the diameter of the mandrel element (17) with respect to the diameter of the coiled winding (16) is equal to or greater than 100%.

3. The lamp of claim 1, wherein the shaft portion and the coiled winding of the electrodes comprises undoped tungsten; and wherein the mandrel element (17) comprises tungsten with a doping material having a low electron emission work function.

4. The lamp of claim 1, wherein the mandrel element (17) and the terminal end of the coiled winding (16) terminate flush with respect to each other.

5. The lamp of claim 1, wherein the terminal end of the mandrel element (717) extends beyond the terminal end of the coiled winding at the side facing the opposite electrode.

6. The lamp of claim 1, wherein the terminal end of the mandrel element (17) extends beyond the terminal end of the coiled winding at the side remote from the opposite electrode.

7. The lamp of claim 4, wherein the mandrel element (17) is retained by the clamping effect of the coiled winding (16).

8. The lamp of claim 5, wherein the mandrel element (17) is retained by the clamping effect of the coiled winding (16).

9. The lamp of claim 6, wherein the mandrel element (17) is retained by the clamping effect of the coiled winding (16).

10. The lamp of claim 4, wherein the terminal end of the mandrel element (17) facing an opposite electrode and the adjacent terminal end of the coiled winding are melted together.

11. The lamp of claim 1, wherein a major constituent of said additives comprises tin.

12. The lamp of claim 1, wherein said coiled winding comprises at least $1\frac{1}{4}$ winding loops.

13. The lamp of claim 1, wherein the mandrel element (17) extends from the shaft portion (15) at an angle of about 90°.

14. The lamp of claim 1, wherein the mandrel element (17) extends from the shaft portion (15) at an angle of greater than 90°.

15. The lamp of claim 1, wherein said additive further includes a metal.

16. The lamp of claim 3, wherein said additive includes a metal.

17. The lamp of claim 3, wherein the mandrel element (17) and the terminal end of the coiled winding (16) terminate flush with respect to each other.

18. The lamp of claim 3, wherein the mandrel element (17) is retained by the clamping effect of the coiled winding (16).

19. The lamp of claim 3, wherein the terminal end of the mandrel element (17) facing an opposite electrode and the adjacent terminal end of the coiled winding are melted together.

20. The lamp of claim 3, wherein said coiled winding comprises at least $1\frac{1}{4}$ winding loops.

21. The lamp of claim 3, wherein said additive includes tin.

22. The lamp of claim 21, wherein the terminal end of the mandrel element (17) facing an opposite electrode and the adjacent terminal end of the coiled winding are melted together;

and wherein the mandrel element (17) and the terminal end of the coiled winding (16) terminate flush with respect to each other.

23. The lamp of claim 1, wherein the power rating of the lamp is up to about 150 W.

* * * * *

UNITED STATES PATENT AND TRADEMARK OFFICE

CERTIFICATE OF CORRECTION

PATENT NO. : 4,851,735

DATED : July 25, 1989

INVENTOR(S) : GOSSLAR et al

It is certified that error appears in the above-identified patent and that said Letters Patent is hereby corrected as shown below:

Abstract, line 11, "includes" should read --include--.

Column 6, line 60. Replace claim 2 with the following:

--The lamp of claim 1, wherein the diameter of the mandrel element (17) divided by the diameter of the coiled winding (16), times 100, is equal or greater than 100%.--

Signed and Sealed this

Seventeenth Day of December, 1991

*Attest:*

HARRY F. MANBECK, JR.

*Attesting Officer*

*Commissioner of Patents and Trademarks*